United States Patent [19]

Schoenenberger

[11] 4,227,390

[45] Oct. 14, 1980

[54] TRANSFER MECHANISM FOR MULTIPLE PUNCH PRESSES

[75] Inventor: Raymond Schoenenberger, Rosenau, France

[73] Assignee: Hatebur Umformmaschinen AG, Basel, Switzerland

[21] Appl. No.: 920,324

[22] Filed: Jun. 29, 1978

[30] Foreign Application Priority Data

Jul. 6, 1977 [DE] Fed. Rep. of Germany ..... 2730490

[51] Int. Cl.[3] ..... B21D 43/10; B21D 55/00

[52] U.S. Cl. ..... 721/4; 10/23; 10/72 T; 10/76 T; 72/26; 72/405

[58] Field of Search ..... 72/405, 421, 26, 31, 72/3, 4; 10/23, 11 T, 12 T, 72 T, 76 T; 214/1 BB

[56] References Cited

U.S. PATENT DOCUMENTS

| | | | |
|---|---|---|---|
| 2,383,313 | 8/1945 | Hoffman | 10/23 |
| 2,768,394 | 10/1956 | Ward | 10/23 |
| 3,150,391 | 9/1961 | Kull | 10/23 |
| 3,319,087 | 5/1967 | Wintriss | 72/26 |
| 3,758,900 | 9/1973 | Morton | 10/23 |
| 4,032,018 | 6/1977 | Wallis | 214/1 BB |

FOREIGN PATENT DOCUMENTS 865820 9/1978 Belgium .

*Primary Examiner*—Francis S. Husar
*Assistant Examiner*—Gene P. Crosby
*Attorney, Agent, or Firm*—Neil F. Markva

[57] ABSTRACT

The present invention relates to transfer mechanism for multiple punch presses with two co-operating pairs of conveyor tongs which are fixed to a carrier element. The carrier element is movably mounted in a housing and driven to-and-fro to the operating rhythm of the punch press. The carrier element includes a bore effective to direct a lubricating fluid therethrough. Lubricating lines supply lubricating fluid to the bore at a desired fluid pressure. The bore has an outlet opening contiguous to the structure which incorporates the conveyor tongs. In the event that the conveyor tongs break away from the carrier element, the outlet opening of the bore is uncovered and the fluid pressure drops. The power supply to the press and the lubricating fluid supply are stopped in response to such a pressure drop.

10 Claims, 4 Drawing Figures

1a
1b
2
3
4
6
7
8
9
10
11
12
13a
13b
13c
13d
14
15
16
17
18
19
II
III

TRANSFER MECHANISM FOR MULTIPLE PUNCH PRESSES

BACKGROUND OF THE INVENTION

It is known that automatic punch presses with transverse transport tongs must include special safety systems which switch off the main drive of the press as soon as an unforeseen obstacle comes into the operating zone of the tongs. Such an obstacle occurs, for example, when a workpiece is incompletely ejected from the die after the shaping operation. Thus, the workpiece can not be seized by the tongs. Consequently, the tongs come up against two workpieces in the subsequent transport phase. Further interruptions of operation of this sort are known to people skilled in the art and need not be discussed here.

The pairs of conveyor tongs are attached to the front end sections of carrying elements which carry out a periodical, to-and-fro sliding movement and must therefore always be lubricated. Flexible tubes are used to lubricate these parts which move to-and-fro at a high frequency. These flexible tubes, used in the prior art are subjected to strong wear due to the continually alternating stresses. Furthermore, these tubes are difficult to arrange in the very small space available.

Most importantly, two completely separate devices had to be used, one for the safety of the machine and another for lubrication of the tong jaw carriers. Such an arrangement is unfavorable because of the space requirements, the lack of structural simplicity and costs of the prior art system.

SUMMARY OF THE INVENTION

These disadvantages of the prior art are overcome by the present invention. The carrying element for the tong means has at least one bore for directing a pressure fluid of oil or an oil-air mixture therethrough.

The mouth or outlet opening of this bore is contiguous to the tong means including an intermediate member and tong jaws, i.e. closed by the tong jaws or by an intermediate member to which the tong jaws are connected. The tong jaws are held onto the carrying element by holding means which are breakable upon the occurrence of a predetermined maximum resistance to cause the tong means to break away from the carrying element and uncover the mouth or outlet opening of said bore. This results in a pressure drop of said lubricating fluid supplied to the bore. Actuation means responsive to the pressure drop causes the press to be stopped by means of a pressure-actuated switch member and the supply of lubricating fluid to be stopped.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

According to FIGS. 1 to 4, the transfer mechanism has, for example, three tong sets. Each set of transfer tongs includes tong means having an upper tong-half 1*a* and a lower tong half 1*b*. Each tong half 1*a* and 1*b* is arranged on a slide (not shown) which is driven to-and-fro to the operating rhythm of the punch press. One possibility of the structure of this drive mechanism is shown in Belgian Pat. No. 865,820. However, the subject matter of the present invention should not be restricted to this construction of the drive mechanism.

The respective tong half is connected to the sliding carriage through an arm 2. The front extremity of arm 2 is just visible in FIG. 3. A housing 3 is fixed on arm 2. Slide 4 is driven to-and-fro in the direction of double-arrow 5 by drive members (not shown) within housing 3. Slide 4 forms the actual carrying element for the tong jaws which seize the workpiece at a shaping station, transport it to the next station and release it there so that it can be pushed by the stamp into the die. The two tong halves 1*a* and 1*b* in FIG. 1 do not have any principle differences in structure. Therefore, the following only refers to upper tong half 1*a*, whereby the details also apply to the lower tong halves 1*b*.

Figures 1, 2:
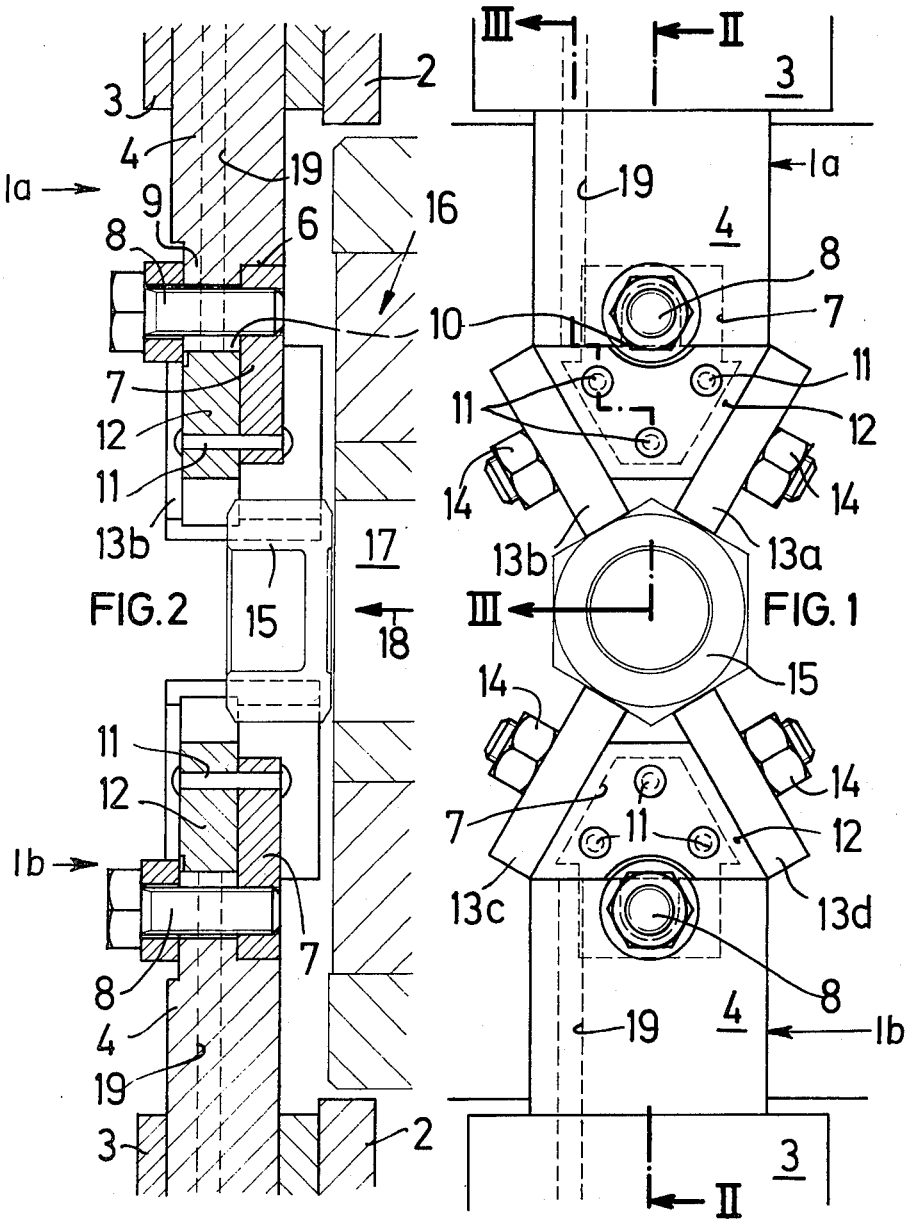
FIG. 1 is a simplified front elevational view of a transverse transport tong made in accordance with the invention.
FIG. 2 is a sectional view along line II—II of FIG. 1.

As shown in FIG. 2, screw 8 anchors base plate 7 to shoulder 6 disposed on the front section of slide 4. The flange 9 of slide 4 includes a lower section having a recess 10 adjacent to shoulder 6. Screw 8 protrudes through recess 10 which is open at the bottom. The base plate 7 is thereby pressed against the vertical surface of shoulder 6 by the tightened screw 8. However, once screw 8 is loosened a little, plate 7 falls freely with screw 8 downwards because recess 10 is open at the bottom as shown.

Three rivets 11 attach jaw carrier 12 to base plate 7. Jaw carrier 12 has a trapezoidal cross-section in accordance with FIG. 1 and screws 14 fix two tong jaws 12*a* and 13*b* on the sides thereof.

The two pairs of tong jaws 13*a*, 13*b* and 13*c*, 13*d* are disposed opposite each other and hold a workpiece 15 which should be pressed into a mother. An ejector 17 is located in the stamp 16 and pushes workpiece 15 in a direction as shown by arrow 18 between the two pairs of tong jaws 13*a*, 13*b* and 13*c*, 13*d* which are in readiness, whereupon these convey the stamping onward to the next forming station.

Figure 3:
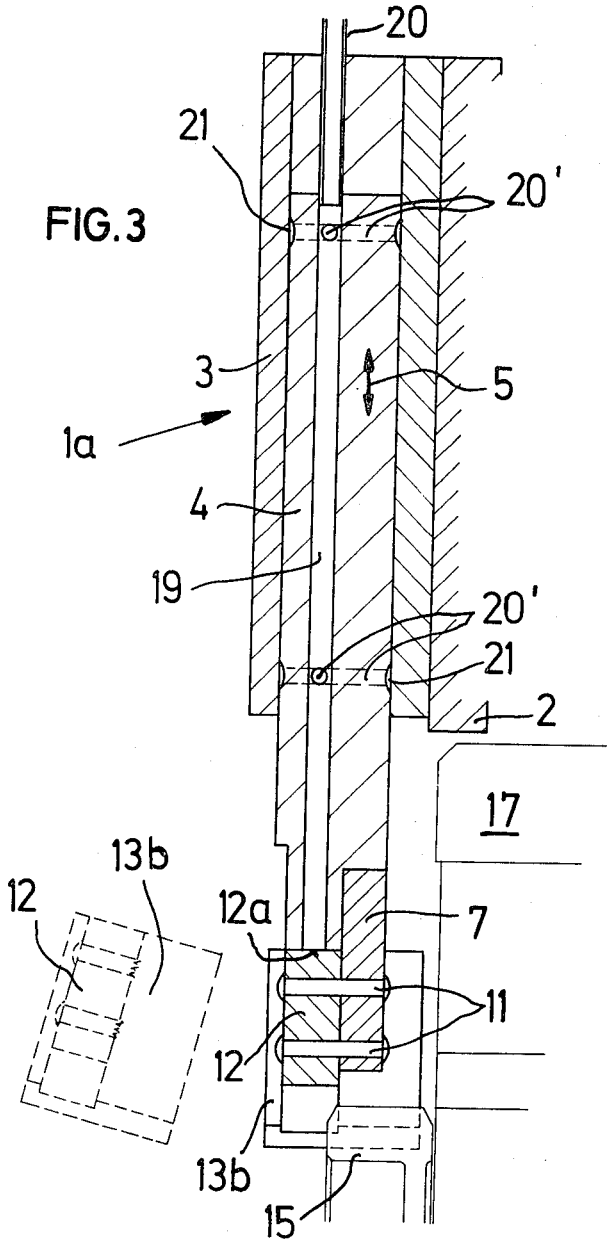
FIG. 3 is a sectional view along line III—III of FIG. 1.

As shown in FIG. 3, slide 4 includes a bore 19 into which a pipe 20 opens from above. The lower mouth of bore 19 lies directly against the side surface 12*a* of jaw carrier 12. Thus, bore 19 is kept practically closed by jaw carrier 12, with the exception of a minimal perviousness which is desired for technical reasons of lubrication. Pipe 20 connects bore 19 to a pressure-fluid source. Oil or a mixture of oil and compressed-air can be used as pressure fluid. In this way, bore 19 can be continually kept under a certain desired over-pressure.

The pressure fluid in bore 19 comprises a proportion of lubricant in all possible embodiments and reaches lubricating openings 21 through transverse bores 20. Openings 21 are arranged on the outside surface of slide 4 and thus effect lubrication between slide 4 and the inner wall of housing 3.

In the event of an unforeseen large resistance occurring on tong jaws 13 and 13*b*, rivets 11 break and jaw carrier 12 falls with tong jaws 13*a* and 13*b* away from base plate 7. This situation is shown in FIG. 3 with dotted lines. In this way, any damaging stresses which may arise are kept away from the drive members of the tong mechanism.

With the separation of jaw carrier 12 from base plate 7, the mouth of bore 19 becomes free so that the pressure fluid can flow out thereby causing the pressure within bore 19 to drop suddenly. This drop in pressure is used both to stop the main drive of the press and to eliminate further supply of the pressure medium to bore 19. A system shown schematically in FIG. 4 is useful for effecting these results.

In a specific embodiment, a selected four-stage punch press includes three shaping stations A, B and C. This system operates on a mixture of oil and compressed-air. The air reaches from an air source through a pressure-reducing valve 22 into a distributor 23 having two chokes 24 and two respective departure tubes 25 for each shaping station. An oil line 26 opens out into each compressed-air departure tube 25 and is supplied intermittently by an oil source 27. Therefore, there is a mixture of oil and compressed-air in the lines 28 which lead to pipes 20 (FIG. 3). The mixture assures lubrication of slide 4 within housing 3 and projects the whole system against unforseen resistances occurring on the tong jaws. To accomplish this latter function, a pressure switch 29 is connected to each line 28 and reacts to a certain drop of pressure arising in line 28 by switching off the main drive of the press.

The device of the invention described effects both lubrication and safety functions by using an uncomplicated and practically maintenance-free system. The system requires only a flexible tube per tong-half for the supply of the pressure medium and no electric cables for transmission of signals. Thus, very little space is required to accommodate the system.

Figure 4:
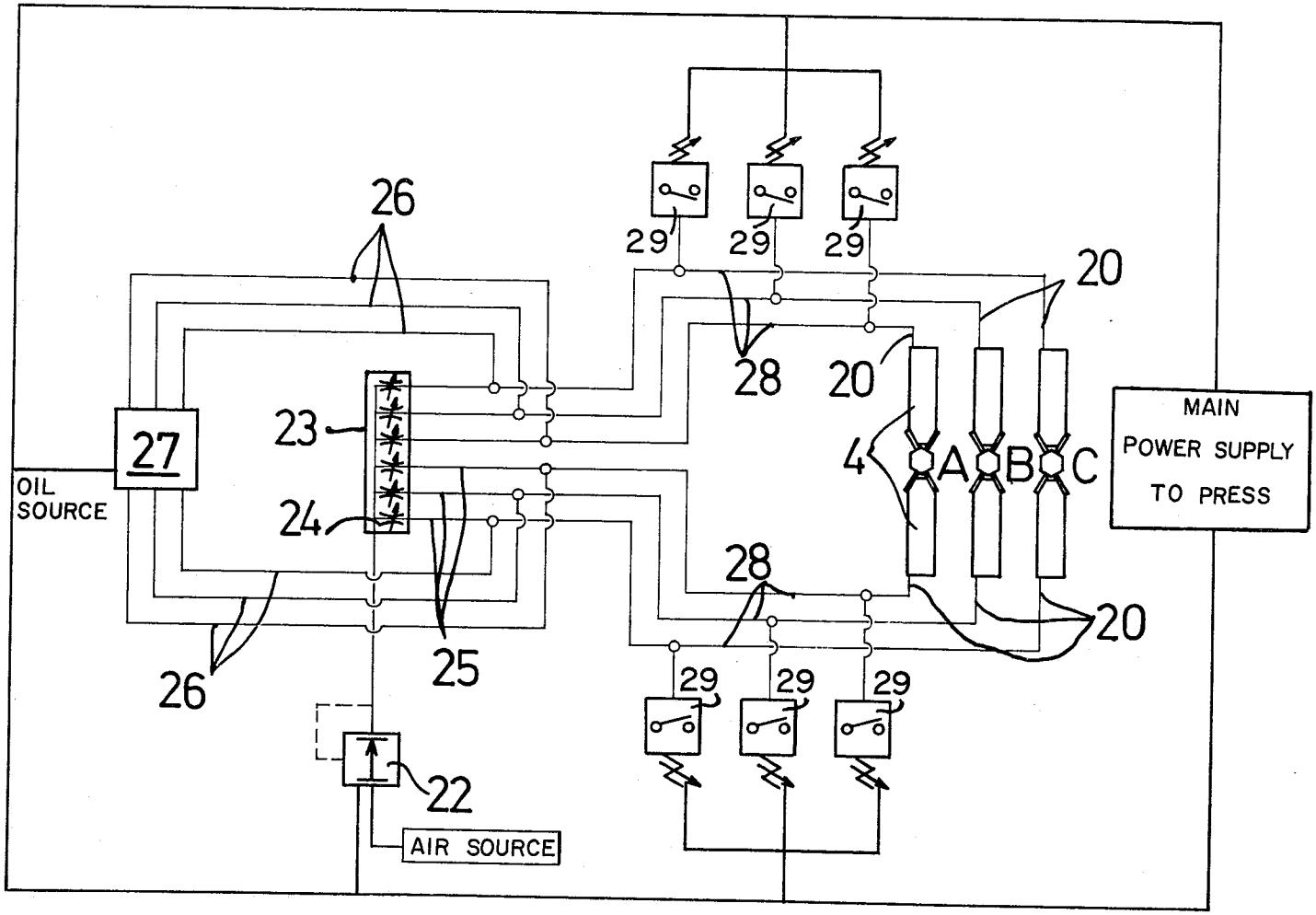
FIG. 4 is a schematic flow diagram of the supply pipes of the pressure medium on a four-stage press intended to form workpieces by four consecutive forming operations.

In another embodiment of the system shown in FIG. 4, it is quite possible to supply bores 19 exclusively with oil. However, a mixture of oil and air is preferred in most cases since spraying out large amounts of oil when the jaw carrier 12 breaks off has much more undesirable consequences than the periodic out-flow of air containing oil.

The upper front surface of jaw carrier 12 and the contact surfaces between the slide 4 and housing 3 do not have to be fully impermeable. On the contrary, a certain permeability is desirable since the continual lubrication of the tong mechanism is thereby assured.

Since the medium for lubrication and safety is always under pressure, there is a certain excess pressure within the parts surrounding the tong mechanism which prevents the penetration of dirt particles.

I claim:

1. A transfer mechanism for a multiple punch press, said mechanism comprising:
   (a) two cooperating pairs of conveyor tong means,
   (b) holding means for connecting each pair of tong means to a movably mounted carrier member,
   (c) each said carrier member including a bore effective to direct a lubricating fluid therethrough,
   (d) lubricating fluid lines connected to supply lubricating fluid to said bore at a desired fluid pressure,
   (e) said bore having an outlet opening contiguous to said tong means while maintaining said fluid pressure,
   (f) said holding means being breakable upon the occurrence of a predetermined maximum resistance to cause tong means to break away from the carrier member and uncover said bore outlet opening, and
   (g) actuation means responsive to a drop in pressure within said lubricating fluid lines when said bore outlet opening is uncovered,
   (h) said actuation means being effective to stop the press when said drop in pressure occurs.

2. A transfer mechanism as defined in claim 1 wherein said tong means includes tong jaws disposed contiguously to said bore outlet opening.

3. A transfer mechanism as defined in claim 1 wherein said tong means includes tong jaws and an intermediate member to which said tong jaws are attached, and
   said intermediate member is contiguous to said bore outlet opening.

4. A transfer mechanism as defined in claim 1 wherein said actuation means include a pressure-activated switch member operatively connected between a main power supply to said press and said lubricating fluid lines.

5. A transfer mechanism as defined in claim 1 wherein said holding means includes a base plate attached to the carrier member and rivet means connecting said tong means to said base plate.

6. A transfer mechanism as defined in claim 1 wherein a recess opens outwardly at the end section of the carrier member and
   bolt means extends through said open recess and connects a base plate to the carrier member.

7. A transfer mechanism as defined in claim 6 wherein rivet means connect said tong means to said base plate.

8. A transfer mechanism as defined in claim 1 wherein said carrier member is slidingly mounted within a housing,
   said carrier member includes transverse bores extending from said lubricating fluid bore to direct lubricating fluid between the contact surfaces between the carrier member and the housing.

9. A transfer mechanism as defined in claim 1 wherein said actuation means is effective to stop the supply of lubricating fluid to said lubricating fluid lines.

10. A transfer mechanism as defined in claim 9 wherein
   said actuation means includes a pressure-activated switch member operatively connected to said lubricating fluid lines.

* * * * *